US008021013B2

(12) United States Patent
Russo et al.

(10) Patent No.: US 8,021,013 B2
(45) Date of Patent: Sep. 20, 2011

(54) LIGHTING ASSEMBLY WITH APERTURE ALIGNMENT ASSEMBLY

(75) Inventors: Neil Russo, Jackson, NJ (US); Shailesh I. Naik, Dayton, NJ (US); Steven M. Silverstein, Woodcliff Lake, NJ (US)

(73) Assignee: Hubbell Incorporated, Shelton, CT (US)

( * ) Notice: Subject to any disclaimer, the term of this patent is extended or adjusted under 35 U.S.C. 154(b) by 366 days.

(21) Appl. No.: 12/347,296

(22) Filed: Dec. 31, 2008

(65) Prior Publication Data

US 2010/0165607 A1 Jul. 1, 2010

(51) Int. Cl.
*F21V 33/00* (2006.01)

(52) U.S. Cl. ..... 362/150; 362/148; 362/269

(58) Field of Classification Search ..... 362/148, 362/150, 147, 285, 269, 270
See application file for complete search history.

(56) References Cited

U.S. PATENT DOCUMENTS

| | | | | |
|---|---|---|---|---|
| 2,518,936 | A | 8/1950 | Roberts | |
| 2,898,075 | A | 8/1959 | McGinty | |
| 2,984,738 | A | 5/1961 | Belau | |
| 4,173,037 | A | 10/1979 | Henderson, Jr. et al. | |
| 4,881,157 | A | 11/1989 | Pahl | |
| 5,800,050 | A | 9/1998 | Leadford | |
| 5,823,664 | A * | 10/1998 | Demshki et al. | 362/366 |
| 5,951,151 | A | 9/1999 | Doubeck et al. | |
| 6,082,878 | A | 7/2000 | Doubek et al. | |
| 6,431,723 | B1 | 8/2002 | Schubert et al. | |
| 6,652,124 | B2 | 11/2003 | Doubek et al. | |
| 7,118,254 | B2 | 10/2006 | Czech | |
| 7,186,008 | B2 | 3/2007 | Patti | |
| 7,234,674 | B2 | 6/2007 | Rippel et al. | |
| 7,374,308 | B2 | 5/2008 | Sevack et al. | |
| 7,625,105 | B1 * | 12/2009 | Johnson | 362/364 |
| 2003/0161153 | A1 * | 8/2003 | Patti | 362/289 |
| 2006/0193142 | A1 | 8/2006 | Dupre | |
| 2006/0261235 | A1 | 11/2006 | Rippel et al. | |
| 2007/0019418 | A1 | 1/2007 | Czech et al. | |
| 2007/0075206 | A1 | 4/2007 | Wright et al. | |
| 2007/0274082 | A1 * | 11/2007 | Kay | 362/364 |
| 2008/0025031 | A1 | 1/2008 | Wronski et al. | |
| 2008/0062693 | A1 | 3/2008 | Czech et al. | |
| 2008/0062705 | A1 | 3/2008 | Czech et al. | |
| 2008/0186717 | A1 | 8/2008 | Ruberg | |
| 2008/0186718 | A1 | 8/2008 | Magisano et al. | |

FOREIGN PATENT DOCUMENTS

| | | |
|---|---|---|
| GB | 2061703 | 5/1981 |

* cited by examiner

*Primary Examiner* — Laura Tso
(74) *Attorney, Agent, or Firm* — Garrett V. Davis; Mark S. Bicks; Alfred N. Goodman

(57) ABSTRACT

A lighting assembly includes a lamp alignment assembly for positioning the lamps after the lighting assembly is installed. The lighting assembly includes a ceiling pan for mounting to the ceiling support and a lamp assembly attached to the ceiling pan. The lamp assembly is adjustable in a transverse and rotational direction with respect to the ceiling pan. The lamp assembly is provided with alignment springs to align the lamp assembly at predetermined settings. A sight window is formed in the ceiling to visually set the lamp assembly in a selected position. A locking member on the lamp assembly locks the lamp assembly in a fixed position on the ceiling pan.

24 Claims, 8 Drawing Sheets

LIGHTING ASSEMBLY WITH APERTURE ALIGNMENT ASSEMBLY

CROSS-REFERENCE TO RELATED APPLICATIONS

This application relates to U.S. application Ser. No. 12/347,253 to Russo et al., filed Dec. 31, 2008 entitled "Lighting Assembly and Lamp Aiming Device", and U.S. application Ser. No. 12/347,324 to Russo et al., filed Dec. 31, 2008 entitled "Lamp Alignment Assembly and Lighting Device", which are hereby incorporated by reference in their entirety.

FIELD OF THE INVENTION

The present invention is directed to a light assembly having an adjustable alignment assembly for adjusting the position of the lamp assembly and for adjusting the direction of the light to a target area. More particularly, the invention is directed to an adjustable light assembly with an adjustable assembly such that the lamp can be adjusted in a selected angular and rotational orientation.

BACKGROUND OF THE INVENTION

Recess lighting fixtures are commonly used in construction. The recess lighting fixtures generally include a base or plaster frame, a lamp holder for holding the electrical lamp and a trim ring. Recessed lighting fixtures provide lighting characteristics that are often desired in new construction and in existing ceilings.

Recessed lighting fixtures are fixed to the ceiling in a specific location and the location of the lighting fixture is often limited by the ceiling structure. Many recessed lighting fixtures have fixed lamps that do not permit adjustment. Depending on the location of the recessed lighting fixture, it may be desirable to aim the lamp in a particular direction to provide the desired lighting pattern or to focus the light in a specific target area. The adjustment mechanisms of many of the prior recessed lighting fixtures are difficult to operate and provide limited orientation of the lamp. The confined area of the recessed lighting fixture also makes it difficult to adjust the position of the lamp after the fixture is installed in the ceiling.

Various devices have been proposed for recessed lighting fixtures and downlights having an adjustment mechanism to enable the adjustment and orientation of the lamp. One example is disclosed in U.S. Published Patent Application No. 2006/0193142 to Dupre. The adjustment device in this published application includes a worm gear drive for aiming a locking mechanism for a luminaire. The luminaire assembly includes a collar and a yoke where the yoke is pivotally connected to the collar. A worm gear is attached to the collar and engages gear teeth on an arm to pivot the yoke with respect to the collar. The collar has an inner collar which rotates axially with respect to the outer collar about a vertical axis. In this manner, the luminaire can pivot about a vertical axis and about a horizontal axis.

U.S. Patent Publication Nos. 2008/0062693 and 2008/0062705 to Czech et al. are directed to a rotatable lamp with a braking mechanism. The mechanism has a rotation ring that is held in place by a ring clamp that is rotatable on a frame. A mechanical brake is provided for locking the ring in place.

U.S. Patent Publication 2008/0186717 to Ruberg relates to a compact luminaire having a lamp module bracket assembly. The assembly has a first band and a second band connected together by a pair of arms. The arms are pivotally connected to the band to allow aiming of the luminaire. A screw is tightened to fix the position of the lamp of the luminaire.

U.S. Pat. No. 5,951,151 to Doubeck et al. discloses a lamp assembly for recessed ceiling fixture having a support assembly for a lamp socket and a lamp. The support assembly has a rotation ring to allow rotation about a vertical axis with respect to the frame. The support assembly also includes arms that are pivotally connected to the rotation ring to allow angular adjustment of the lamp about a horizontal axis.

U.S. Pat. No. 6,082,878 to Doubeck et al. discloses a rotatable recessed light fixture with a movable stop member. A spin disk has an upwardly extending tab which engages a stop member upon rotation of the spin disk. The lamp mechanism is able to rotate with the spin disk about a vertical axis. A lamp support also includes a support member for the lamp where the support member is pivotally connected to the lamp mechanism. The support member has a pair of legs with projections which slide within an arcuate slot formed in a bracket that is fixed to the ring. The legs enable the lamp mechanism to pivot about a horizontal axis and a vertical axis with respect to the frame.

U.S. Pat. No. 6,652,124 to Schubert et al. relates to an adjustable light fixture having a rotation adjustment assembly and an angle adjustment assembly for directing a lamp to a target area. The light fixture includes a frame having an aperture and a mounting disk. The mounting disk includes arms which form an angle adjustment assembly for the lamp. A rotation assembly is pivotally connected to the arms and the angle adjustment assembly. The rotation assembly includes a rotation disk and a rotation frame which holds the lamp. The position of the lamp can be adjusted about a horizontal axis and a vertical axis by rotating the rotation assembly with respect to the arms and the mounting disk.

Other adjustable lamp assemblies are disclosed in U.S. Patent Publication No. 2008/0186718 to Magisano et al., U.S. Pat. No. 4,173,073 to Henderson, Jr. et al., U.S. Pat. No. 4,881,157 to Pahl and GB 2,061,703 to Gilbert.

Although the prior devices function in the intended manner, these devices are relatively complicated and can be difficult to adjust the position of the lamp in some situations. Therefore, there is a continuing need in the industry for improved adjustment mechanisms for lamp assemblies.

SUMMARY OF THE INVENTION

The present invention is directed to an adjustable lighting fixture that can be used for ceiling-mounted assemblies or recessed lighting assemblies. The invention is particularly directed to an adjustable lighting assembly where the lamp can be adjusted to direct the light to the target area and where the lamp assembly can be aligned with the ceiling pan.

The light assembly of the invention includes a ceiling pan and a lamp assembly where the position of the lamp assembly is adjustable with respect to the ceiling pan. The ceiling pan has an aperture defining a central open area for directing light downwardly from the lamp assembly. The lamp assembly is adjustable to align the lamp with the aperture of the lamp assembly. The lamp assembly includes a lamp holder and lamp which can be rotated about a vertical axis and adjusted about a horizontal axis independent of the adjustment about the vertical axis. The adjustable light assembly of the invention can include a single lamp holder and lamp or a plurality of lamp holders and lamps where each lamp can be adjusted independently of the other.

One aspect of the invention is to provide an adjustable light assembly that is easy to construct and assemble by the technician. In one embodiment of the invention, the lamp assembly is adjustable after the ceiling pan is mounted to the ceiling support. The lamp assembly can be adjusted easily by rotating about a vertical axis or moved or moved laterally to align the lamp with respect to the aperture in the ceiling pan. The lamp can be rotated about a vertical axis and about a horizontal axis after the light assembly is installed and mounted in a ceiling.

Another aspect of the invention is to provide an adjustable lighting assembly having a locking member that is able to fix the position of the lamp assembly with respect to the ceiling pan. The locking member is attached to the lamp assembly and engages the ceiling pan to prevent rotation and transverse movement of the lamp assembly on the ceiling pan.

The various aspects of the invention are obtained by providing an adjustable light assembly comprising a ceiling pan and a lamp assembly mounted on the ceiling pan. The ceiling pan and the lamp assembly have an opening for directing light in a downward direction. The lamp assembly is rotatably adjustable on the ceiling pan. An alignment member is included to align and position the lamp assembly at a predetermined position with respect to the ceiling pan. The lamp assembly is also adjustable in a transverse direction on the ceiling pan and can be locked in position by a locking member.

The aspects of the invention are also obtained by providing a lighting assembly comprising a ceiling pan for coupling to a ceiling support. The ceiling pan has a substantially planar bottom wall and a substantially circular opening in the bottom wall. A lamp assembly has a base secured to the ceiling pan and an opening aligned with the opening in the ceiling pan. A rectangular sleeve extends from the base and encircles the opening. The sleeve extends through the opening in the ceiling pan. The lamp assembly is rotatably and transversely adjustable with respect to the ceiling pan. A plurality of hold down members on the ceiling pan attach the lamp assembly to the ceiling pan and limit transverse movement of the lamp assembly with respect to the ceiling pan. A stop member limits rotational movement of the lamp assembly with respect to the ceiling pan.

The aspects of the invention are also obtained by providing a lighting assembly comprising a ceiling pan adapted for coupling to a ceiling support. The ceiling pan has a substantially planar bottom wall with a centrally located opening to enable light to be directed to a target area. A lamp assembly has a base mounted on a top surface of the bottom wall and has a centrally located opening aligned with the opening in the ceiling pan. A sleeve extends from an edge of the opening of the base and is adapted for extending into the opening in the ceiling pan. The lamp assembly is rotatable and transversely adjustable with respect to the ceiling pan. At least one hold down member on the ceiling pan limits vertical movement of the lamp assembly with respect to the ceiling pan. A locking member on the lamp assembly engages the ceiling pan to fix the position of the lamp assembly with respect to the ceiling pan.

The various aspects of the invention are further attained by providing a lighting assembly comprising a ceiling pan adapted for coupling to a ceiling support. The ceiling pan has a bottom wall with a sight window and an opening therein to enable light to be directed to a target area. A lamp assembly has a base mounted on a top surface of the bottom wall. The bottom wall has an opening therein aligned with the opening in the ceiling pan. The lamp assembly is movable in a transverse direction with respect to the ceiling pan. A lamp is coupled to the base for directing light through the opening in the base. An indicator on the base is visible through the sight window for aligning the lamp assembly in a predetermined position with respect to the ceiling pan. A plurality of hold down members on the ceiling pan capture the lamp assembly.

These and other aspects of the invention will become apparent from the following detailed description of the invention and the annexed drawings which disclose various embodiments of the invention.

BRIEF DESCRIPTION OF THE DRAWINGS

The following is a brief description of the drawings in which.

DETAILED DESCRIPTION OF THE INVENTION

Figure 1:
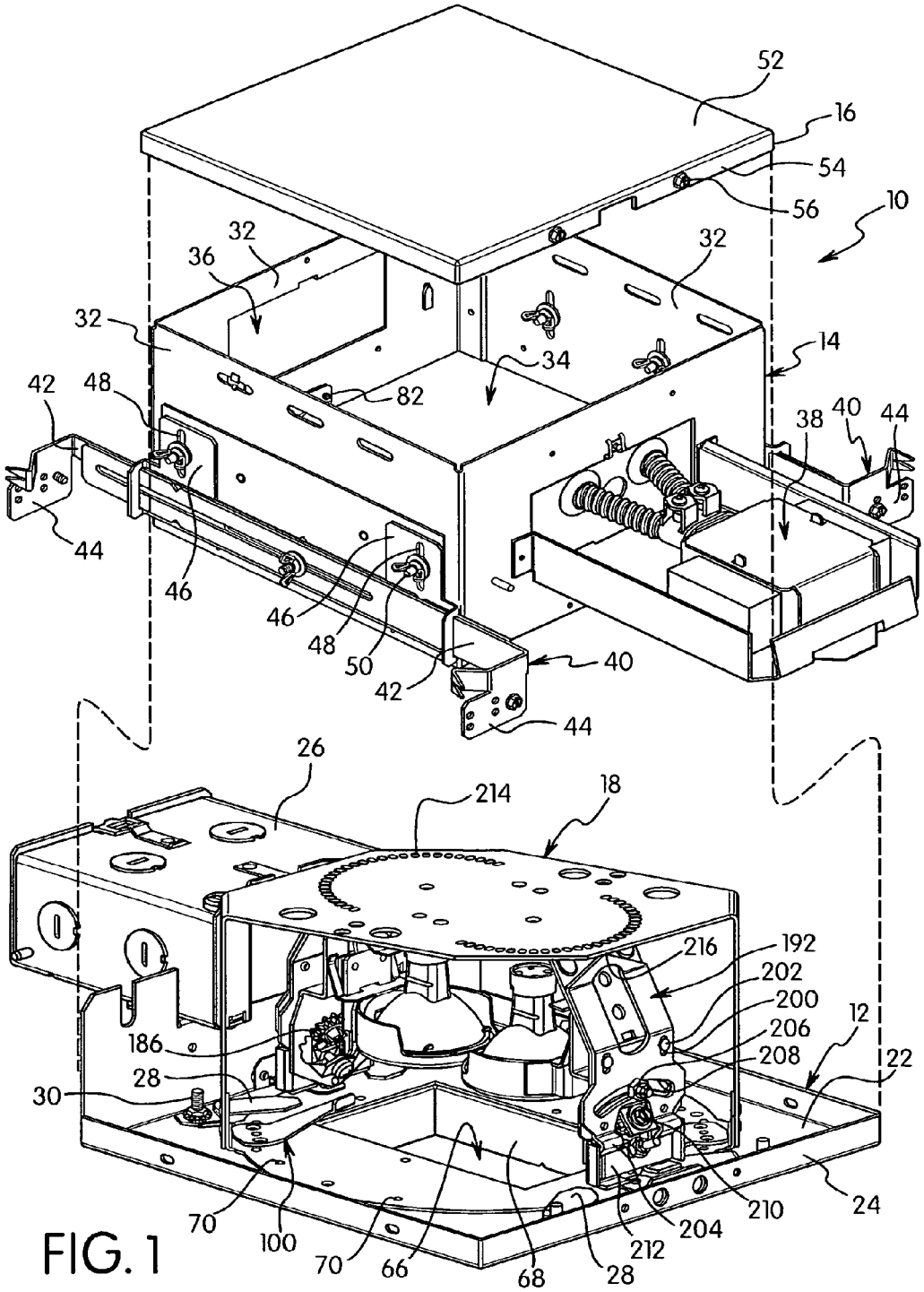
FIG. 1 is an exploded perspective view of one embodiment of the adjustable light assembly of the invention.

The present invention is directed to a light assembly having a ceiling pan and a lamp assembly. The invention is particularly directed to a light assembly where the position of the lamp assembly includes two independently adjustable lamps to direct the light to a target site.

Referring to the drawings, the luminaire and light assembly 10 of the invention includes a ceiling pan 12 having a housing 14 with a cover 16 closing the top end of the housing 14. Positioned within the housing 14 is light assembly 18 having a lamp support and aiming assembly.

Figure 4:
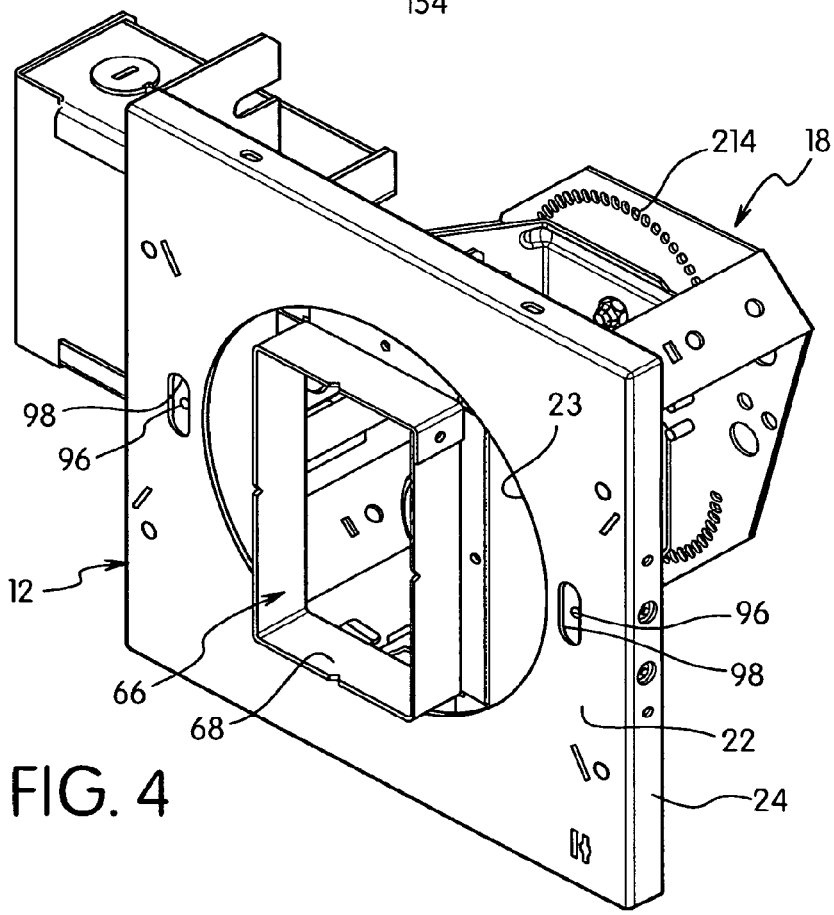
FIG. 4 is a bottom perspective view of the lighting assembly of FIG. 3.

Referring to FIG. 1, ceiling pan 12 is constructed for mounted in a ceiling in a conventional manner. Ceiling pan 12 has a flat bottom wall 22 with an upwardly extending peripheral flange 24. An electrical box 26 is mounted to flange 24 for enclosing electrical wiring components for the assembly in a conventional manner. Bottom wall 22 has a central opening 23 below light assembly 18 for directing light to the target site as shown in FIG. 4. Hold down brackets 28 are provided for coupling light assembly 18 to ceiling pan 12. In the embodiment illustrated, hold down brackets 28 are attached to bottom wall 22 by screws 30 or other fasteners. Hold down brackets 28 have a substantially L shape and overlie the top surface of light assembly 18 to allow axial rotation and limited lateral movement of light assembly 18 with respect to ceiling pan 12. In use, a trim ring and diffuser (not shown) are attached to the bottom side of light assembly 10.

Housing 14 has a side wall 32 with an open bottom 34 and an open top 36. Side walls 32 of housing 14 are coupled to flange 24 of ceiling pan 12 by screws or other fasteners. An electrical box 38 is coupled to side wall 32 containing electrical components for light assembly 18.

Adjustable mounting hanger bars 40 are attached to opposite side walls 32 of housing 14. Mounting bars 40 include extending bars 42 having mounting tabs 44 for mounting to ceiling joists or other support structure. Mounting bars 42 are mounted to a mounting bracket 46 for sliding movement. Mounting bracket 46 includes slots 48 for receiving adjusting screws 50. Slots 48 allow vertical adjustment of mounting bars 40 with respect to housing 14 so that housing 14 and ceiling pan 12 can be vertically adjusted after mounting bars 40 are attached to a ceiling joist or other support. Adjusting screws 50 are tightened to fix the position of housing 14 with respect to hanger bar 42.

Cover 16 includes top wall 52 having a downwardly extending flange 54. Flange 54 is coupled to side wall 32 of housing 14 by screws 56 to enclose light assembly 18.

Figure 2:
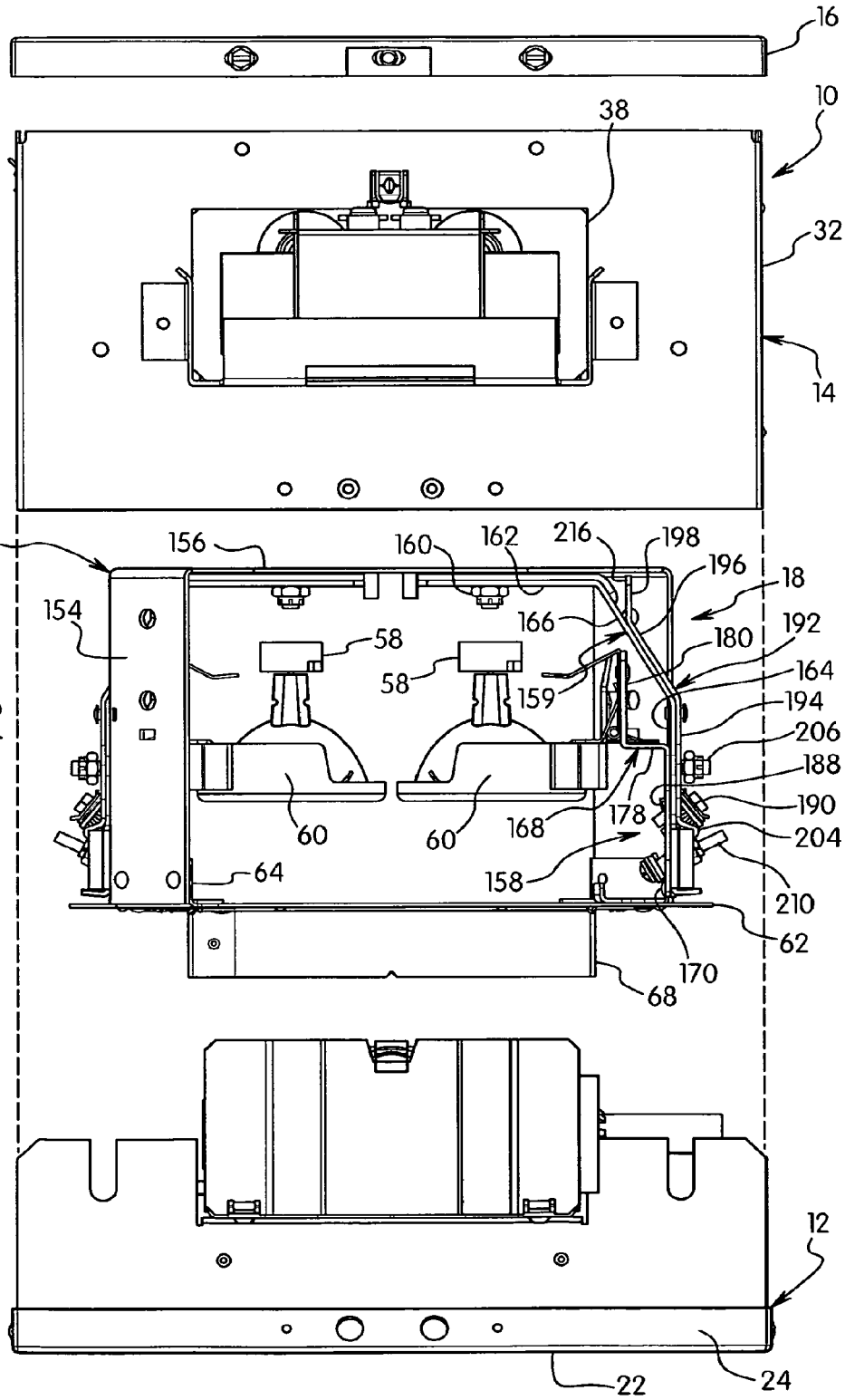
FIG. 2 is an exploded elevational view of the light assembly of FIG. 1.
Figure 3:
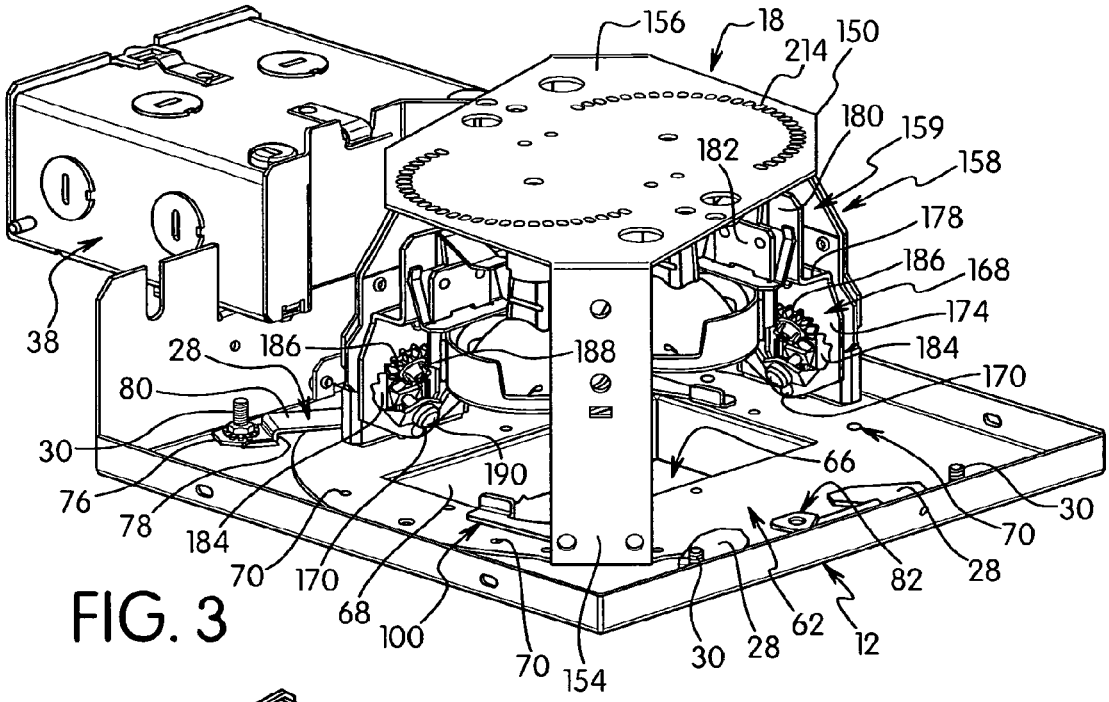
FIG. 3 is a perspective view of the lighting assembly with the housing removed from the lamp assembly.

In the embodiment of FIG. 1, light assembly 18 includes two lamps 58 with each mounted to a respective lamp support 60. Each lamp 58 and lamp support 60 are independently adjustable with respect to the other to direct light to different areas or focus the light to a common or overlapping area. Referring to FIGS. 2 and 3, light assembly 18 includes a base 62 and a bracket 64. Base 62 in the embodiment illustrated has a substantially flat circular shape with a dimension to fit within flanges 24 of ceiling pan 12. Base 62 has a central opening 66 and a sleeve 68 extending downwardly from a bottom side of base 62. Sleeve 68 extends from the peripheral edge of central opening 66 for directing light from lamps 58 to the target area. In the embodiment shown, sleeve 68 extends through the opening in bottom wall 24 of ceiling pan 12.

In the embodiment of FIG. 2, sleeve 68 has a substantially rectangular configuration corresponding to the two lamp supports 60 and respective lamps 58. In other embodiments, sleeve 68 can have any shape and dimension corresponding to the desired lighting pattern. Sleeve 68 extends through the opening in ceiling pan 12 and has a dimension less than the dimension of opening 23 in ceiling pan 12 to allow rotational and lateral movement of light assembly 18 with respect to ceiling pan 12.

Base 62 preferably includes a plurality of spaced apart embossed dimples 70 extending downwardly to provide glide members between light assembly 18 and the bottom wall 22 of ceiling pan 12.

Dimples 70 are formed by pressing or punching from the base 62 in a downward direction and have a height to space the bottom surface of base 62 from the top surface of ceiling pan 12. Dimples 70 have an outer end with a surface area sufficient to support lamp assembly 18 while reducing friction between lamp assembly 18 and ceiling pan 12. The dimples 70 are preferably spaced apart around the central opening in the base of lamp assembly 12 and positioned to adequately support the lamp assembly. The number of dimples depend on the size and dimension of lamp assembly 18. In the embodiment illustrated, eight dimples are provided and are positioned to contact the ceiling pan radially outward from the central opening in the ceiling pan.

Hold down brackets 28 are spaced apart a distance to attach base 62 of lamp assembly 18 to ceiling pan 12. As shown in FIGS. 3 and 5-7, hold down brackets have a base 76 coupled to ceiling pan 12 by screws 30, an upwardly extending portion 78 and leg 80. Leg 80 is spaced from ceiling pan 12 a distance sufficient to capture base 62 of lamp assembly 18 while allowing limited transverse and rotational movement of lamp assembly 18 with respect to ceiling pan 12. In the embodiment illustrated, four hold down brackets are provided.

Figure 5:
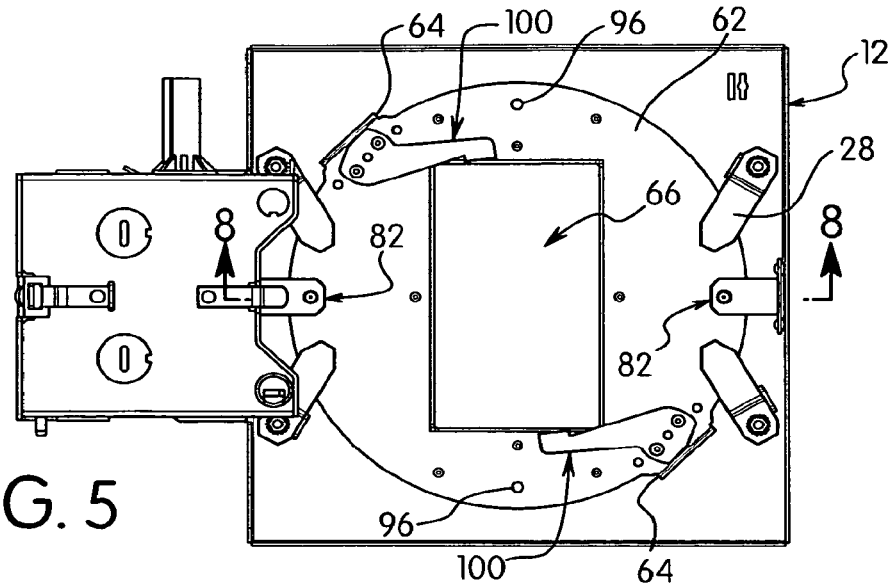
FIG. 5 is a top view of the lighting assembly of FIG. 3 showing the base with the lamp support removed and with the base in a first position.
Figure 6:
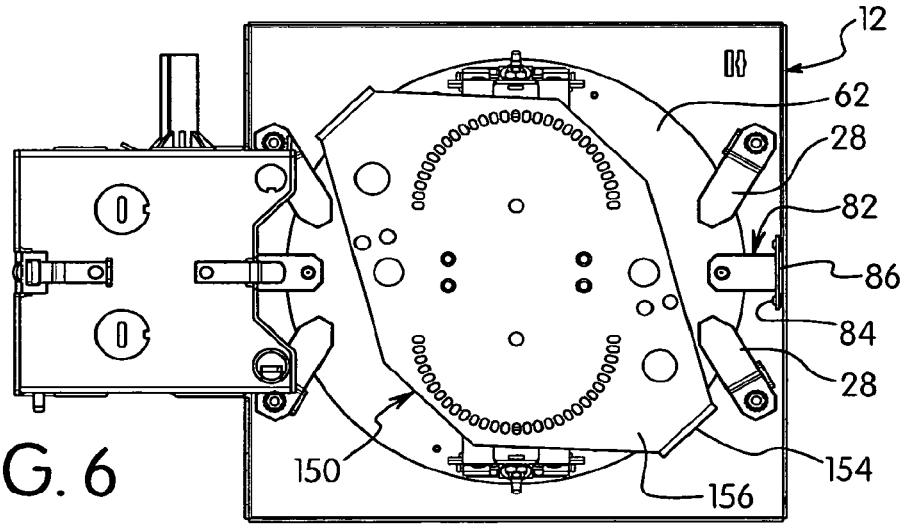
FIG. 6 is a top view of the lighting assembly showing the lamp assembly in the first position of FIG. 5.
Figure 7:
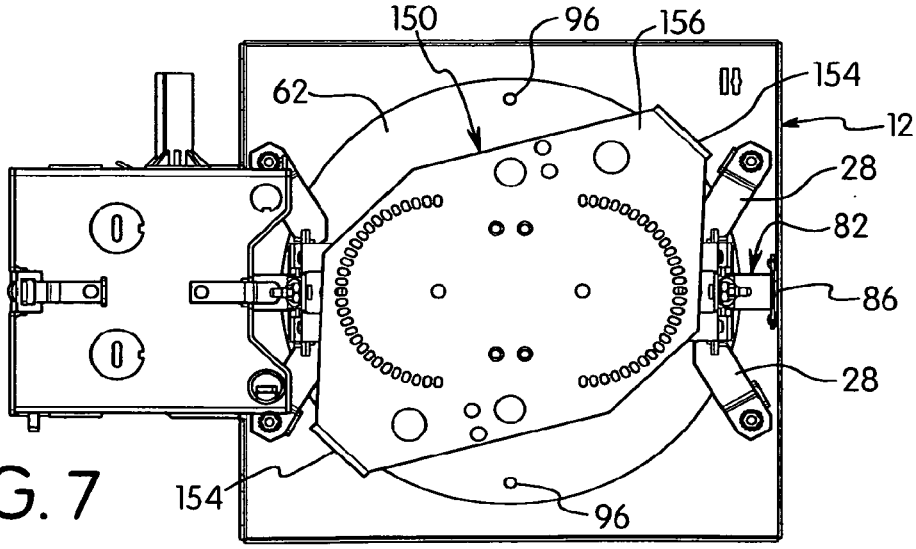
FIG. 7 is a top view of the light assembly shown rotated to a second position.

Lamp assembly 18 includes a stop assembly to limit rotation of lamp assembly 18 with respect to ceiling pan 12 to enable the angular position of lamp assembly 18 to be adjusted and positioned for directing light to a selected area. In the embodiment of the present invention, bracket 64 functions as a stop member by being positioned to cooperate with hold down brackets 28. Referring to FIGS. 5-7, support brackets 64 extend upwardly from base 62 of lamp assembly 18 at an outer peripheral edge of base 62. Lamp assembly 18 can be rotated on ceiling pan 12 toward a first of a pair of hold down brackets 28 as shown in FIG. 5. As can be seen in FIG. 5, rotation of lamp assembly 18 will cause support bracket 28 to engage the hold down bracket thereby limiting further rotation. As shown in FIG. 7, lamp assembly 18 can be rotated in an opposite direction until support bracket 28 engages a second of the hold down brackets. As can be seen, the rotational movement of lamp assembly 18 is determined by the spacing between the hold down brackets on opposite sides of the support bracket on base 62 of lamp assembly 18. In one embodiment of the invention, hold down brackets 28 are spaced apart a distance to allow lamp assembly 18 to rotate about 90°. The rotation of lamp assembly 18 on ceiling pan 12 allows the selective orientation of the two lamps such that the lamps can be aligned along a first axis or a second axis that are perpendicular to each other as shown in FIGS. 6 and 7.

Referring to FIG. 4, sleeve 68 has a dimension less than the dimension of the central opening of ceiling pan 12. Hold down brackets 28 are spaced a distance to enable base 62 to be adjusted in a transverse direction within the confines of the hold down brackets. Sleeve 68 has a dimension smaller than the dimension of the central opening in ceiling pan 12 so that sleeve 68 and base 62 can be adjusted in a transverse direction with respect to ceiling pan 12. In one embodiment of the invention, the dimension of the sleeve 68, the dimension of the central opening in the ceiling pan and the spacing of the hold down brackets allow movement and lateral positioning of lamp assembly 18 of about ¼ inch in all directions. In this manner, lamp assembly 18 can be moved to position sleeve 68 at any location and at any angular orientation with respect to the central opening in ceiling pan 12.

Figure 8:
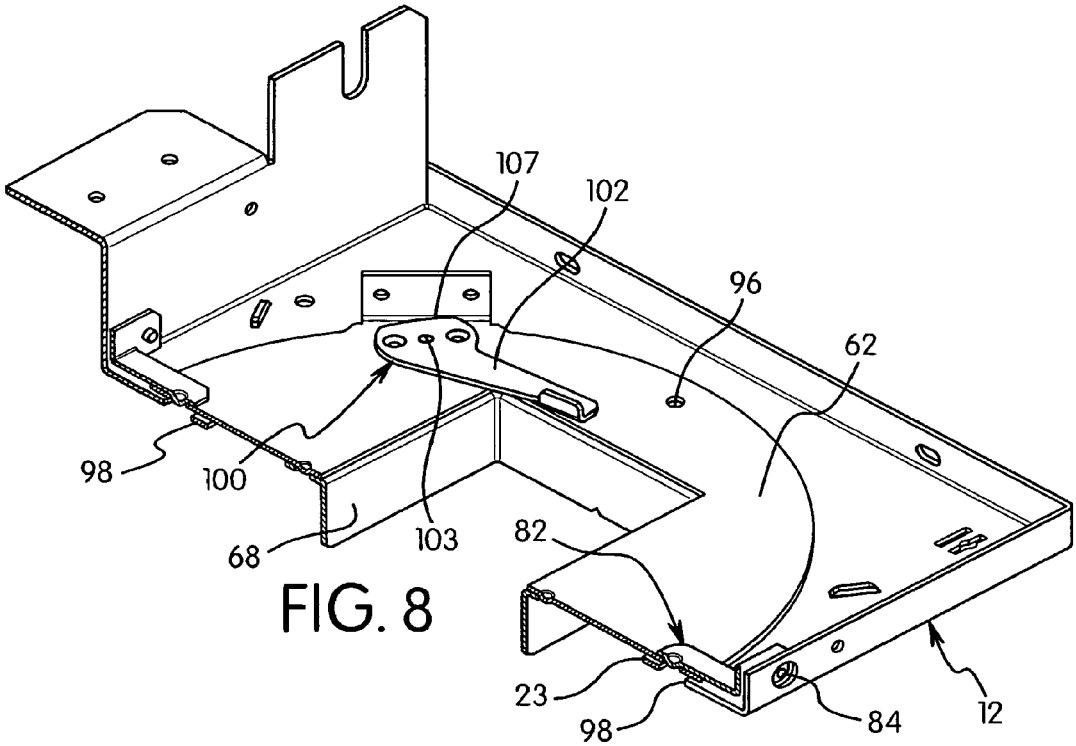
FIG. 8 is a cross-sectional view of the lighting assembly taken along line 8-8 of FIG. 5.
Figure 9:
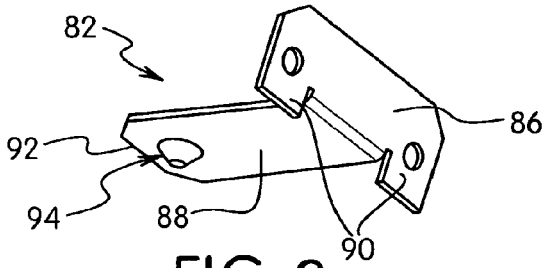
FIG. 9 is a bottom perspective view of the locator spring.

Light assembly 10 in one embodiment includes an alignment mechanism to position lamp assembly 18 at one or more predetermined positions with respect to ceiling pan 12. The alignment mechanism includes an alignment spring 82 which contacts base 62 of lamp assembly 18 to hold lamp assembly 18 in position. Spring 82 in one embodiment is coupled to ceiling pan 18. As shown in FIGS. 3 and 8, two springs 82 are attached to opposite sides of ceiling pan 12 by fasteners 84 such as rivets or screws. Spring 82 has a base 86 for attachment to side wall 32 of housing 14 as shown in FIG. 1. A leg 88 is cut from base 86 as shown in FIG. 9 to form a pair of tabs 90 which contact the top surface of ceiling pan 12. Tabs 90 preferably have a height to position leg 88 to continuously contact the top surface of base 62 of lamp assembly 18. In the embodiment illustrated, alignment springs 82 are attached to housing 14 so that when housing 14 is fitted onto ceiling pan 12, alignment springs overlie base 62 of lamp assembly 18. In alternative embodiments, alignment springs 82 can be attached directly to flange 24 of ceiling pan 12.

Figure 10:
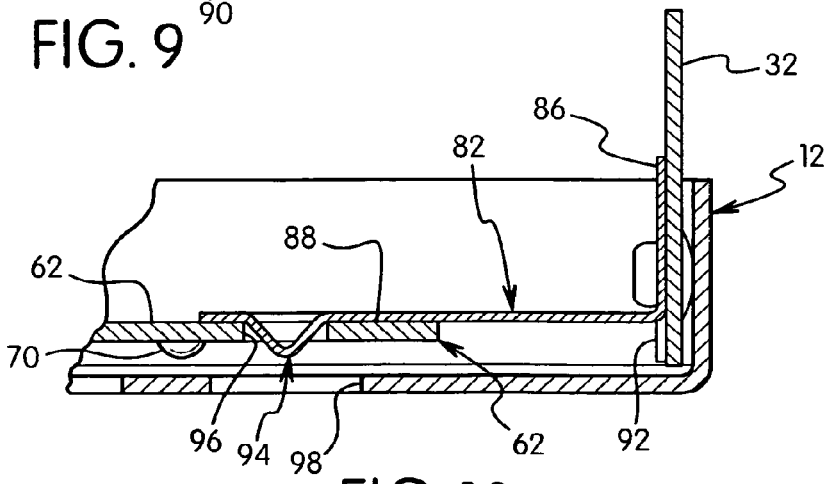
FIG. 10 is an enlarged partial cross-sectional view of the locator spring positioning the base of the lamp assembly.

Leg 88 has a planar configuration and extends substantially perpendicular to base 86. An end 92 of leg 88 includes a downwardly extending detent 94 or dimple that is punched or embossed from leg 88. Detent 94 has a substantially frustoconical shape as shown in FIG. 9. Base 62 of lamp assembly 18 includes one or more holes 96 positioned to receive detent 94 as shown in FIG. 10. Preferably, a plurality of holes 96 are spaced apart around base 62 to define predetermined locations for lamp assembly 18 with respect to ceiling pan 12. In the embodiment illustrated, two springs 82 are attached to ceiling pan 12 on opposite sides and between two adjacent hold down brackets 28. A hole 96 is provided on opposite sides of base 62 to mate with the respective spring.

In one preferred embodiment, holes 96 are provided in base 62 to provide a predetermined factory set position where lamp assembly 18 is oriented such that the two lamps are aligned parallel to a side edge of ceiling pan 12. Alignment holes 96 are preferably provided at substantially 90° to each other so that lamp assembly 18 can be aligned in a second position 90° to the first position. Additional holes can also be provided to align lamp assembly 10 at various angles such as, for example, 45° or 30° . The holes 96 are positioned so that detent 94 snaps into a respective hole 96 to provide a visual and tactile sensation of the selected alignment. Springs 82 provide a downward biasing force sufficient to retain lamp assembly 18 in positions during mounting of light assembly 10. The tension applied by springs 82 can be overcome by manually rotating or sliding base 62 to separate the detent of the spring from the respective hole whereby lamp assembly 18 can be moved to a selected position within the limits of the hold down brackets.

In a preferred embodiment of the invention, sight windows 98 are provided in ceiling pan 18 to provide visual orientation of lamp assembly 18 from below after light assembly 10 is installed in the ceiling. Preferably, sight windows 98 are positioned directly below springs 82 so that the respective detent in the springs 82 are visible when received in an alignment hole 96 in base 62. The sight windows 98 on opposite sides of the ceiling pan enable visual alignment of lamp assembly 18 to preset positions.

A locking assembly 100 is provided to lock and fix the position of lamp assembly 18 with respect to ceiling pan 12. Preferably, locking assembly 100 is able to fix the position of the lamp assembly 18 to prevent rotation and lateral movement on ceiling pan 12 after adjusting to the selected position on the ceiling pan. In the embodiment illustrated, two locking assemblies are on opposite sides of base 62.

Figure 11:
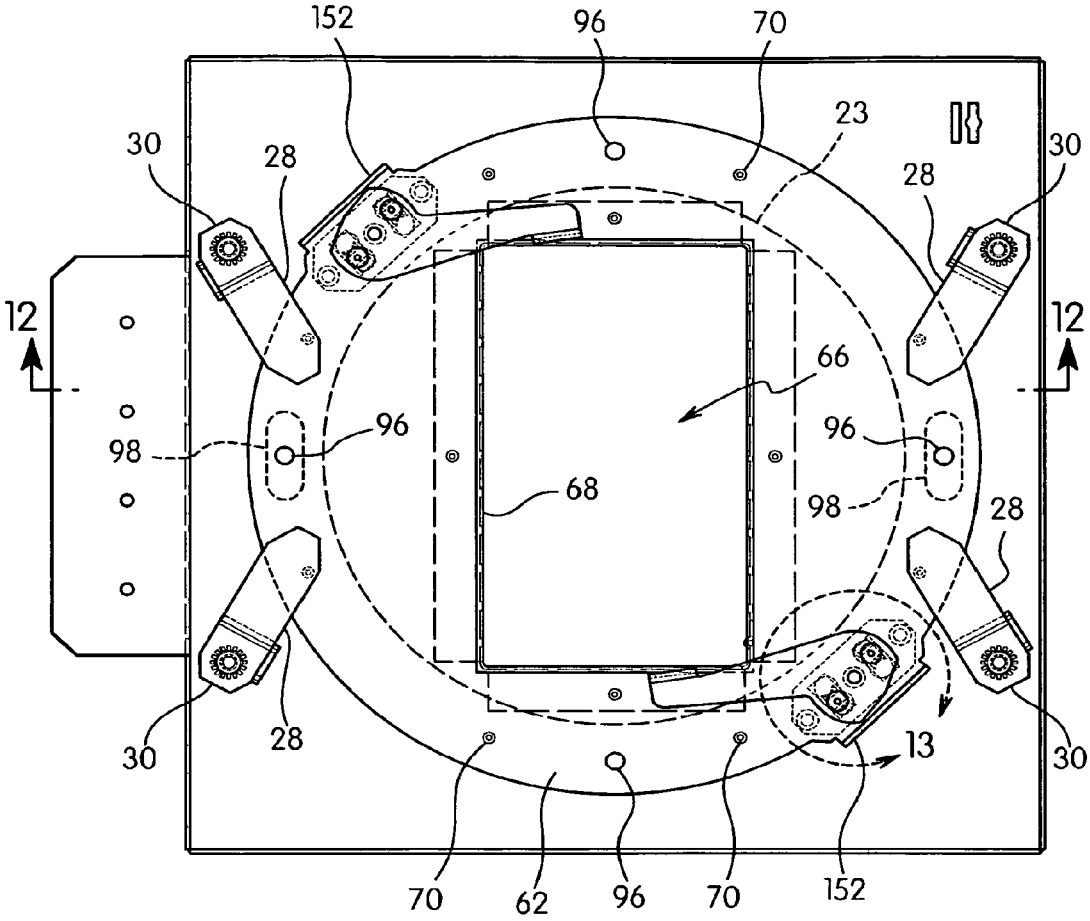
FIG. 11 is a top view of the assembly showing the locking members in the locked position.
Figure 15:
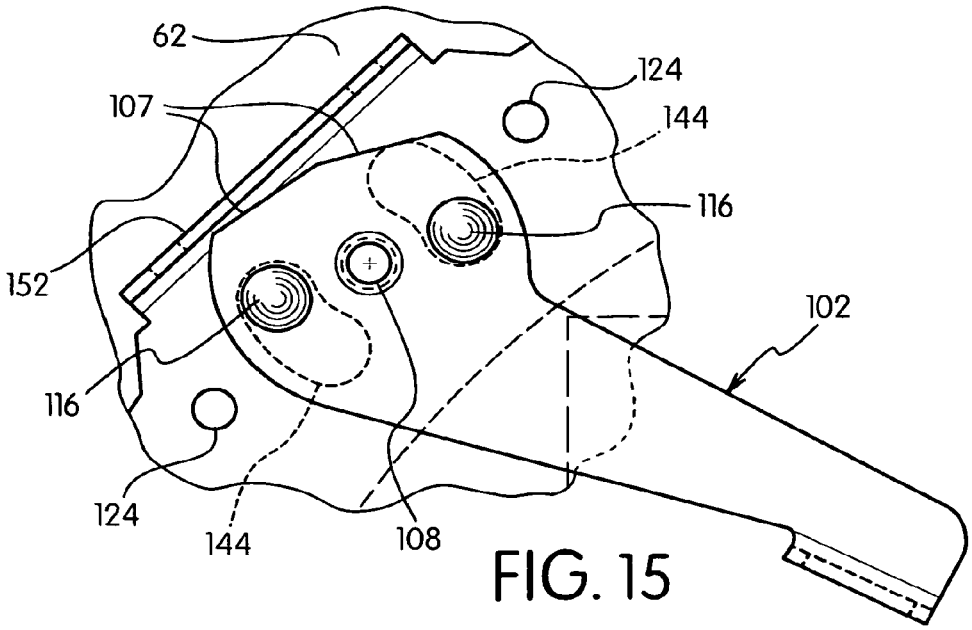
FIG. 15 is a partial top view of the locking assembly.

Locking assembly 100 includes a locking arm 102 and a locking spring 104. Locking arm 102 is pivotally coupled to the top surface of base 62 of lamp assembly 18 in one embodiment of the invention shown in FIGS. 11-13. Locking arm 102 includes a hole 103 at an operating end 106 for receiving pivot pin 108. Operating end 106 has converging flat edges 107 to contact bracket 64 of base 62 to limit pivoting movement of locking arm 102 as shown in FIGS. 11 and 15. Pivot pin 108 can be riveted as shown that extends through a corresponding hole 110 in base 62. Locking arm 102 has an actuating end 112 with an operating tab 114 for manually moving locking arm 102.

Figure 14:
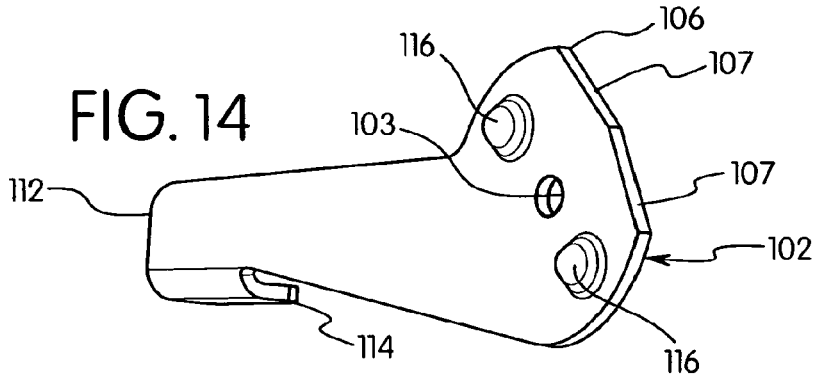
FIG. 14 is a perspective view of the locking arm showing the detents.

Referring to FIGS. 14 and 15, locking arm 102 includes two detents 116 on opposite sides of hole 103 to form a cam surface. As shown in FIGS. 14 and 15, detents 116 are formed by embossed or punched areas and extend outwardly from the bottom face of locking arm 102. Detents 116 typically have a substantially frustoconical shape.

Figure 16:
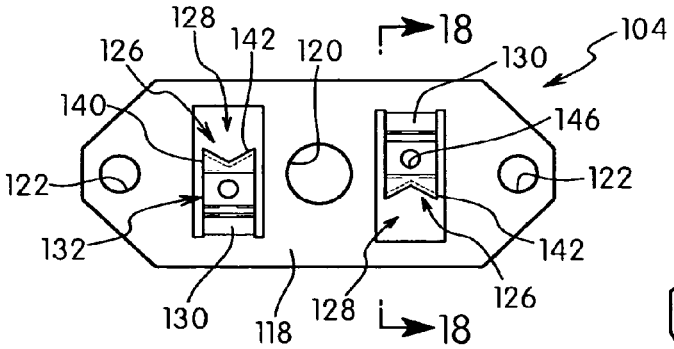
FIG. 16 is a top view of the locking plate of the locking assembly.
Figure 17:
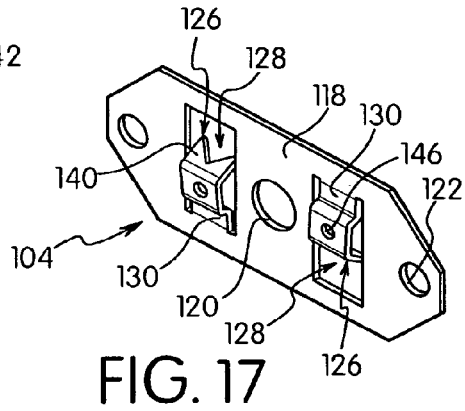
FIG. 17 is a perspective top view of the locking plate showing the locking fingers.

Locking springs 104 as shown in FIGS. 16 and 17 have a substantially planar base plate 118 that is attached to a bottom side of base 62 of lamp assembly 18. Base plate 118 includes a hole 120 for receiving pivot pin 108 and a pair of mounting holes 122 for receiving fasteners 124 for attaching base plate 118 to the bottom surface of base 62.

Base plate 118 includes two spring arms 126 forming a brake that is cut or punched from base plate 118. Each spring arm 126 is cut from base plate 118 to form an opening 128 where each spring arm 126 is connected to one end of the respective opening 128. Spring arm 126 has a leg 130 extending substantially parallel to the plane of base plate 118 and a substantially U-shaped end portion 132. The U-shaped portion 132 has a first portion 134 extending upwardly from a top surface of base plate 118, a flat actuating portion 136 parallel to the plane of base plate 118 and a downwardly extending leg 140. Leg 140 has a length to extend from base plate 118 a distance to contact the ceiling pan. In the embodiment shown, leg 140 includes teeth 142 for gripping ceiling pan 12.

Figure 12:
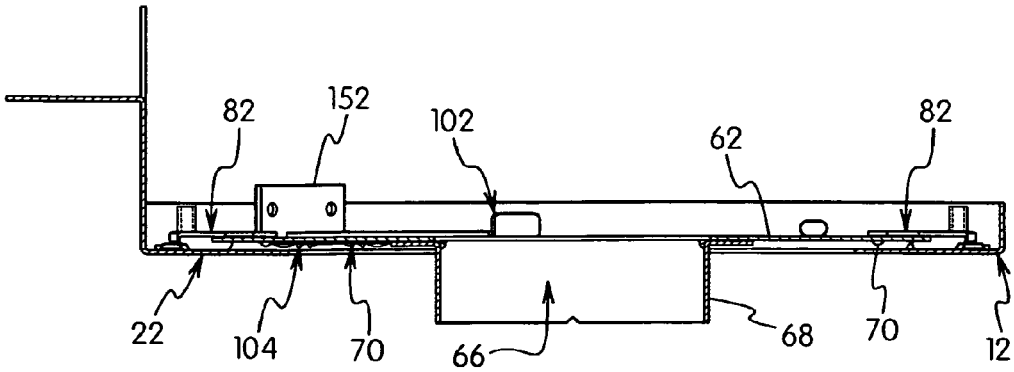
FIG. 12 is a cross-sectional view of the lighting assembly taken along line 12-12 of FIG. 11.
Figure 13:
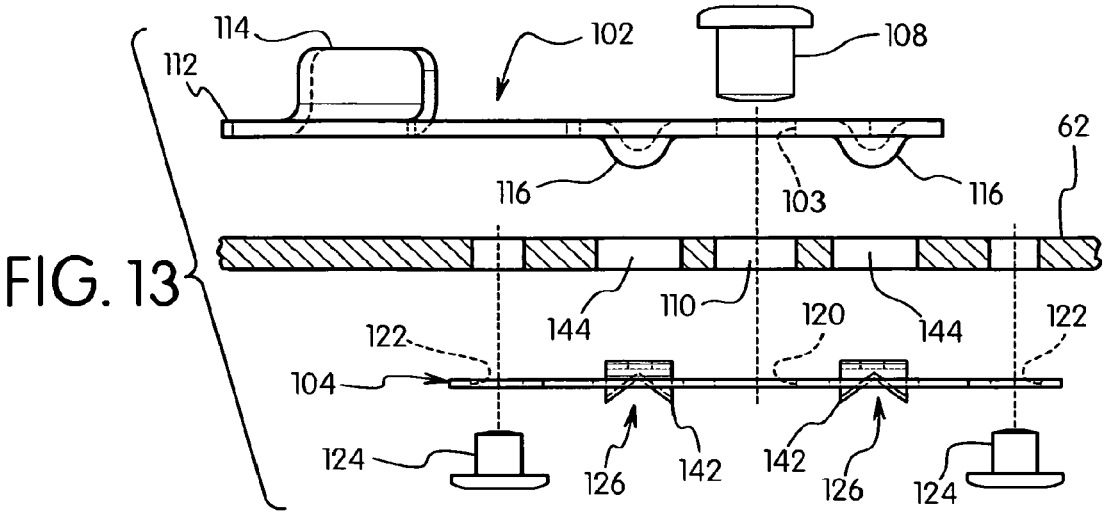
FIG. 13 is an exploded view of the locking assembly.
Figure 18:
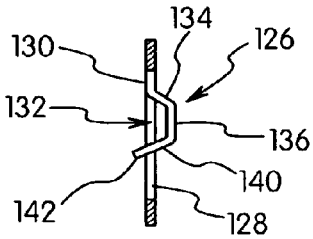
FIG. 18 is a cross-sectional view of the locking spring taken along line 18-18 of FIG. 16.
Figure 19:
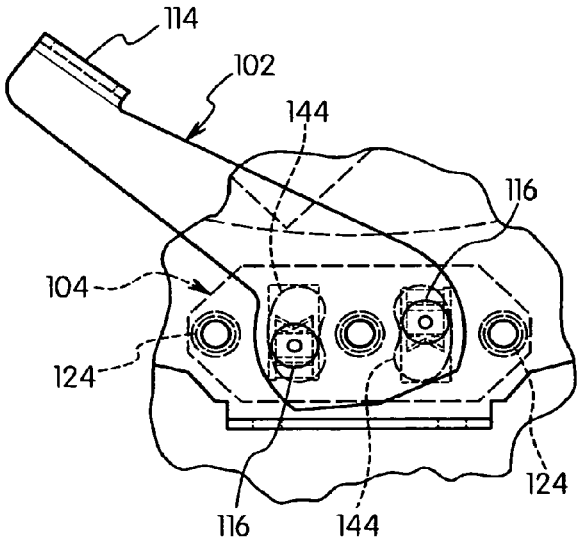
FIG. 19 is a top view of the locking assembly showing the locking arm in the locked position.
Figure 20:
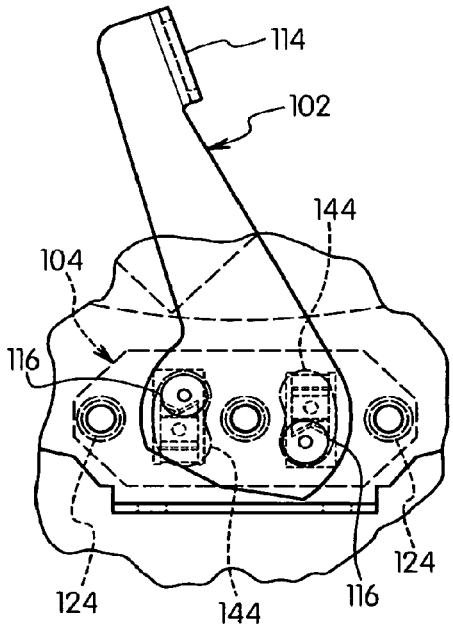
FIG. 20 is a top view showing the locking assembly showing the locking arm in the unlocked position.

Referring to FIGS. 14, 18 and 19, base 62 of lamp assembly 18 is provided with curved slots 144 on opposite sides of the pivot pin hole. Slots 144 have a dimension to receive detents 116. Slots 144 have a length so that detents 116 slide within the respective slots by the pivotal movement of locking arm 102. The length of slots 144 assist in limiting the pivotal movement of locking arm 102. Base plate 118 of locking spring 104 is attached to the bottom surface of base 62 of lamp assembly 18 with the U-shaped portions 132 extending through the respective slot 144. Locking arm 102 is movable between an unlocking position shown in FIG. 18 to a locking position shown in FIG. 19. In the unlocked position of FIG. 20, detents 116 of locking arm 102 overlie the respective leg 130 so that spring arms 126 are retracted to the position shown in FIGS. 16 and 17. Leg 130 is normally biased to the position of FIG. 16. Locking arm 102 is pivoted to the locking position shown in FIG. 19 where detents 116 engage U-shaped portion 132 and bend spring arm 126 downwardly. Detents 116 are captured in an aperture 146 in U-shaped portion 132 to retain locking arm 102 in the locking position. The downward movement of spring arm 126 causes teeth 142 to bite into ceiling pan 12 and push base 62 upward into contact with hold down members 28, thereby wedging base 62 between the hold down members and the bottom wall of ceiling pan 12 as shown in FIG. 12.

A frame 150 is coupled to base 62 by screws or rivets. As shown in FIG. 3, base 62 includes upwardly extending brackets 64 for coupling to frame 150. Frame 150 includes two upwardly extending arms 154 and a top wall 156 extending between arms 154 to form a yoke. Arms 154 are coupled to flanges 152 and extend upwardly from base 62. Top wall 156 has a substantially planar shape and is oriented substantially parallel to base 62. Top wall 156 of frame 150 is spaced from base 62 a distance to support the lamp 58 and lamp support 60.

Lamp support 60 of light assembly 18 includes an adjustment assembly 158 for adjusting the angular position of lamp support 60 and the corresponding lamp 58 as shown in FIGS. 1 and 3. Adjustment assembly 158 in preferred embodiments is pivotally coupled to frame 150 as shown in FIG. 2. Preferably, assembly 158 is coupled to top wall 156 of frame 150 by a nut and bolt assembly 160 to enable the assembly 158 to pivot about a vertical axis substantially perpendicular to the plane of base 62. The vertical axis is defined by the normal orientation of the assembly. The assembly 158 includes a bracket 159 with a top leg 162 having an aperture for receiving the bolt 158 and being substantially parallel to a bottom surface of top wall 156 of frame 150. Bracket 159 includes a bottom leg 164 which extends in a vertical direction perpendicular to the plane of base 62 and is substantially perpendicular to the plane of top leg 162. In the embodiment illustrated, top leg 162 and bottom leg 164 are connected by an intermediate inclined portion 166. Bottom leg 164 has a bottom end that is spaced above the top surface of base 62 so that bracket 159 is supported by frame 150 above base 62.

Referring to FIG. 2, a lamp support bracket 168 is coupled to bracket 159 by a pivot pin 170. Pivot pin 170 is typically a rivet or screw that extends through aligned holes in lamp support bracket 168 and bracket 159 to enable pivotable movement between the components.

Lamp support bracket 168 pivots with respect to bracket 159 about an axis substantially perpendicular to the axis of rotation of bracket 159 with respect to top wall 156 of frame 150. In preferred embodiments, lamp support bracket 168 pivots about a horizontal axis with respect to a longitudinal dimension of bracket 159 and the plane of base 62. Lamp support bracket 168 pivots to allow angular adjustment of the respected lamp 58 to direct light through central opening 66 and sleeve 68 in the desired direction.

Lamp support bracket 168 as shown in FIG. 2 includes a body having a bottom end with a pivot hole for receiving pivot pin 190. The body has a top end forming an outwardly extending leg 178 and an upwardly extending leg 180. A lamp holder 182 is coupled to upper leg 180 for supporting the lamp 58 as shown in FIG. 2. Preferably, lamp holder 60 is coupled to upper leg 180 by rivets or other suitable fasteners.

The body of lamp support bracket 168 includes an outwardly extending angled flange 174 having an aperture and an open area 184. The flange is formed at an incline with respect to the plane of bracket 168. A central open area 184 has a curved top edge with a plurality of teeth 186. Bracket 168 includes an angled flange with an aperture extending away from an open area. The angled flange of bracket 168 is aligned with the open area 184 of lamp support bracket 168.

A beveled gear 188 is rotatably coupled to the flange of bracket 168 by a fastener such as a bolt 190. Bolt 190 extends through a washer and a spring washer. Bolt 190 is threaded into a threaded hole in the axial end of beveled gear 188 to rotatably mount beveled gear 188 to bracket 159. Beveled gear 188 has a slotted end for receiving a screw driver or other tool for manually rotating beveled gear 188. As shown in FIG. 3, beveled gear 188 meshes with teeth 186 in opening 184 of lamp support bracket 168. Rotating beveled gear 188 causes lamp support bracket 168 to pivot about pivot pin 170 with respect to bracket 64. The width of opening 184 which receives beveled gear 188 defines the limits of the angular adjustment of lamp support bracket 168 with respect to bracket 159 and base 62 of lamp assembly 18.

Lamp assembly 18 further includes a locking member 192 coupled to bracket 156. Locking member 192 has a body 194, an angled portion 196 and an upwardly extending tab 198 corresponding substantially to the shape of bracket 159 as shown in FIG. 2. Body 194 and angled portion 196 overlie the bottom leg and angled portion respectively of bracket 159 as shown in FIG. 2. Tab 198 extends in an upward direction substantially parallel to body 194.

Referring to FIG. 1, body 194 of locking member 192 has two spaced apart elongated slots 200 that are aligned with holes in bracket 159 which receive rivets 202 or other fasteners. Rivets 202 extend through the holes and slots 200 to allow limited linear movement of locking member 192 with respect to bracket 159. As shown in FIG. 1, locking member 192 slides in an up and down direction. Rivets 202 preferably have enlarged heads to couple the locking member to bracket 159.

Body 194 of locking member 192 has an open portion adjacent the bottom end. Body 194 is formed with a bend 204 extending outwardly and forming an inclined cam surface. A flat bottom portion extends from the cam surface and lies in the plane of body 194.

The body of lamp support bracket 168 includes a threaded screw 206 extending outwardly perpendicular to the plane of the body and through a curved arcuate shaped slot in bracket 159 and a curved arcuate slot 208 in locking member 192. A threaded nut is coupled to the end of screw 206 as shown in FIG. 2. The curved slots overlie each other and have substantially the same length and pivotal movement of lamp support bracket 168 with respect to bracket 159 and locking member 192. The curved slot of bracket 159 has a width corresponding substantially to the outer dimension of screw 206 so that the slot can slide easily on screw 206. Curved slot 208 of locking member 192 has a width greater than the diameter of screw 206 to allow limited linear movement of locking member 192 in the up and down direction.

A locking screw 210 extends through a washer and through the aperture in the angled flange of lamp support bracket 168. A clamping member 212 is coupled to locking screw 210. Clamping member 212 includes an inclined flange with a hole aligned with the aperture in the angled flange of lamp support bracket 168. Locking screw 210 extends through a hole in the flange of clamping member 212. The angled flange is formed with the side edges of clamping member 212 with a dimension corresponding substantially to the outer dimension of the nut. Side portions are spaced apart a distance to substantially prevent rotation of the nut whereby rotation of the screw draws the nut and clamping member toward lamp support bracket 168. Locking screw 210 extends through a hole in the flange and is threaded into a nut to couple clamping member 212 to the assembly.

Referring to FIGS. 1 and 2, top wall 156 of frame 150 includes a plurality of holes 214 arranged in an arcuate path around the pivot point of bracket 64 defined by the nut and bolt 160. As shown in FIG. 3, frame 152 is provided with a plurality of holes 214 arranged in a semi-circular pattern which allow bracket 159 to pivot about 180°. Locking member 192 includes a point 216 extending upwardly from the upper tab for selectively engaging one of the holes 214 to lock bracket 64 with respect to the frame and prevent rotation about the vertical axis. Tightening locking screw 210 forces the top edge of clamping member 212 into engagement with the inclined cam surface of the locking member which urges the locking member in an upward direction so that the point is received in one of the holes to prevent rotational movement of bracket 64 about the vertical axis with respect to the frame. Simultaneously, the clamping force of locking screw prevents rotation of the lamp support bracket about the horizontal axis with respect to bracket 64.

Light assembly 18 is constructed so that the beveled gear and locking screw are accessible through the open end of base 62. During use, the assembly is mounted to a ceiling by the mounting bars. The technician is able to adjust the position of each light assembly 18 through the central opening in base 62 by rotating bracket 64 manually to the desired position. Each of the light assemblies 18 are independently adjustable with respect to each other. A screw driver or other tool can then be inserted through the central opening of base 62 to engage the beveled gear. Rotating beveled gear adjusts the angular position of lamp support bracket with respect to bracket 64. After lamp support bracket is adjusted to the desired position, the locking screw is tightened using a suitable tool to lock the assembly in place.

While various embodiments have been described and shown in the drawings, it will be understood by one skilled in the art that various changes and modifications can be made without departing from the scope of the invention as defined in the appended claims.

What is claimed is:

1. A lighting assembly comprising:

a ceiling pan for coupling to a ceiling support, said ceiling pan having a substantially planar bottom wall and having a substantially circular opening in said bottom wall;

a lamp assembly having a base secured to said ceiling pan and having an opening aligned with said opening in said ceiling pan, a rectangular sleeve extending from said base and encircling said opening in said base, said sleeve extending through said opening in said ceiling pan, said lamp assembly being rotatably and transversely adjustable with respect to said ceiling pan, said sleeve being rotatable within said opening in said ceiling pan;

a plurality of hold down members on said ceiling pan for attaching said lamp assembly to said ceiling pan and limiting transverse movement of said lamp assembly with respect to said ceiling pan; and a stop member for limiting rotational movement of said lamp assembly with respect to said ceiling pan.

2. The lighting assembly of claim 1, wherein said stop member is provided on said base and engages said ceiling pan to limit rotational movement of said lamp assembly.

3. The lighting assembly of claim 1, wherein said lamp assembly further comprises:

a lamp support extending upwardly from a lamp support bracket of said base; and a lamp mounted on said lamp support;

wherein said lamp support bracket defines said stop member and is positioned to contact at least one of said hold down members to limit rotational movement of said lamp assembly.

4. The lighting assembly of claim 1, wherein said stop member is provided on said base, and where said stop member is positioned to contact two adjacent hold down members to limit rotation of said lamp assembly in a first direction and in a second direction.

5. The lighting assembly of claim 1, wherein said ceiling pan includes at least one sight window; and said lamp assembly includes at least one indicator, said indicator being visible through said sight window to align said lamp assembly visually to a predetermined position with respect to said ceiling pan.

6. The lighting assembly of claim 1, wherein said lamp assembly comprises at least one lamp support and a lamp coupled to said lamp support, said support and said lamp being adjustable about a vertical axis and about a horizontal axis with respect to said lamp assembly.

7. The lighting assembly of claim 6, wherein said lamp assembly further comprises a support bracket coupled to said base for supporting said lamp support, wherein said support bracket is positioned to contact two adjacent hold down members to limit the rotational movement of said lamp assembly.

8. The lighting assembly of claim 1, wherein said lamp assembly further comprises a pair of lamp supports receiving a lamp for directing light through said opening in said base and said opening in said ceiling pan, each of said lamp supports having an adjustment assembly for adjusting the position of the respective lamp about a vertical axis and about a horizontal axis.

9. A lighting assembly comprising:

a ceiling pan adapted for coupling to a ceiling support, said ceiling pan having a substantially planar bottom wall with a centrally located opening to enable light to be directed to a target area;

a lamp assembly having a base mounted on a top surface of said bottom wall and having a centrally located opening aligned with said opening in said ceiling pan, a sleeve extending from an edge of said opening of said base and adapted for extending into said opening in said ceiling pan, said lamp assembly being rotatable and transversely adjustable with respect to said ceiling pan;

at least one hold down member on said ceiling pan for limiting vertical movement of said lamp assembly with respect to said ceiling pan; and a locking member on said lamp assembly for engaging said ceiling pan to fix the position of said lamp assembly with respect to said ceiling pan.

10. The lighting assembly of claim 9, further comprising a plurality of said hold down members on said ceiling pan and spaced apart around said opening in said ceiling pan and having an end overlying a top surface of said base, and where said locking member is movable to a locking position to move said base into engagement with said hold down members to fix the position of said lamp assembly with respect to said ceiling pan.

11. The lighting assembly of claim 9, wherein said locking member is movable to a locking position to move said base into engagement with said at least one hold down member to fix the position of said lamp assembly.

12. The lighting assembly of claim 11, wherein said locking member includes a pivotally mounted arm and a brake member, wherein said arm is pivotable to said locking position to contact said brake member and move said brake member downwardly into engagement with said ceiling pan.

13. The lighting assembly of claim 12, wherein said locking member includes at least one cam member engaging said brake member and where said brake member includes a locking spring.

14. The lighting assembly of claim 13, wherein said brake member includes a base plate coupled to said base of said lamp assembly, and where said locking spring extends from said base plate and is spring biased in a direction away from said ceiling pan.

15. The lighting assembly of claim 14, wherein said locking spring has a detent for engaging said cam member on said locking member.

16. A lighting assembly comprising:

a ceiling pan adapted for coupling to a ceiling support, said ceiling pan having a bottom wall with an opening therein to enable light to be directed to a target area and a sight window spaced from said opening in said bottom wall;

a lamp assembly having a base mounted on a top surface of said bottom wall, said base having an opening therein aligned with said opening in said ceiling pan, said lamp assembly being movable in a transverse direction with respect to said ceiling pan, a lamp coupled to said base for directing light through said opening in said base;

an indicator on said base and being visible through said sight window for aligning said lamp assembly in a predetermined position with respect to said ceiling pan; and a plurality of hold down members on said ceiling pan for capturing said lamp assembly.

17. The lighting assembly of claim 16, further comprising two of said sight windows in said ceiling pan and two of said indicators on said base corresponding to a respective sight window.

18. The lighting assembly of claim 16, wherein said indicator is an aperture in said base.

19. The lighting assembly of claim 18, further comprising a locator spring coupled to said ceiling pan for engaging a top surface of said base.

20. The lighting assembly of claim 19, wherein said locator spring has a detent extending therefrom for engaging said indicator in said base.

21. The lighting assembly of claim 19, wherein said locator spring has a detent extending therefrom for engaging said indicator in said base.

22. The lighting assembly of claim 16, further comprising a locking member on said lamp assembly for fixing the position of said lamp assembly with respect to said ceiling pan.

23. The lighting assembly of claim 22, wherein said locking member engages said ceiling pan to move said base into engagement with said hold down members.

24. The lighting assembly of claim 16, wherein said lamp assembly further comprises a sleeve around said opening and extending from said base into said opening in said bottom wall, said sleeve being movable transversely and rotatably in said opening in said bottom wall.

* * * * *